US009366043B2

(12) United States Patent
Schlipper

(10) Patent No.: US 9,366,043 B2
(45) Date of Patent: Jun. 14, 2016

(54) SAFETY TETHER FOR A HAND-HELD ARTICLE

(71) Applicant: MRM HK LIMITED, Hong Kong (HK)

(72) Inventor: Robert Wesley Schlipper, Hong Kong (HK)

(73) Assignee: MRM HK Limited, Hong Kong (HK)

( * ) Notice: Subject to any disclaimer, the term of this patent is extended or adjusted under 35 U.S.C. 154(b) by 0 days.

(21) Appl. No.: 14/288,412

(22) Filed: May 28, 2014

(65) Prior Publication Data

US 2015/0345158 A1 Dec. 3, 2015

(51) Int. Cl.

| | |
|---|---|
| ***A45F 5/00*** | (2006.01) |
| ***E04G 21/32*** | (2006.01) |
| ***B65D 30/00*** | (2006.01) |

(52) U.S. Cl.

CPC ..... *E04G 21/3261* (2013.01); *B65D 29/00* (2013.01)

(58) Field of Classification Search

CPC ..... A45F 2005/006; A45F 2200/0583; A45F 5/021; E04G 21/3261; B65D 29/00; Y10T 24/39; Y10T 24/3933; Y10T 24/398; Y10T 24/4534; Y10T 24/45351; Y10T 24/45372; Y10T 24/1394; F16B 45/02

USPC ..... 224/269, 254, 220, 904, 148.1, 224/148.4–148.6; 248/690–692; 24/3.12; 220/482

See application file for complete search history.

(56) References Cited

U.S. PATENT DOCUMENTS 1,566,192 A * 12/1925 Forrest ..... A44B 15/00 224/254

(Continued)

FOREIGN PATENT DOCUMENTS

EP 2341256 A2 7/2011

OTHER PUBLICATIONS

Dropsafe. "Dropsafe Christmas eFlyer," Dropsafe dba Newmar Ltd List, Dec. 20, 2012.

(Continued)

*Primary Examiner* — Nathan J Newhouse
*Assistant Examiner* — Jennifer N Zettl
(74) *Attorney, Agent, or Firm* — Faegre Baker Daniels LLP

(57) ABSTRACT

A safety tether is able to secure a wide variety of different hand-held articles directly to a user, particularly for overhead work. A resilient bag holds the article and is formed by joining portions of a wire at nodes such that the bag is biased to a collapsed state to form a mesh. Mouth loops of the mesh are circumferentially spaced around a mouth of the bag. A hook fastener includes a hook onto which the mouth loops are inserted to draw the mouth closed and a gate for closing the hook to retain the mouth loops. The hook fastener is connected to one end of a retractable leash, the opposing end of which is attached to the user's apparel. The bag may also have a clip by which it may be hung from a user's apparel.

10 Claims, 8 Drawing Sheets

(56) References Cited

U.S. PATENT DOCUMENTS 1,797,098 A * 3/1931 Minehart ..... A45F 5/02 224/268
1,927,382 A * 9/1933 Andrew ..... H01R 4/186 16/108
1,959,633 A * 5/1934 Madden ..... H02G 3/0481 138/111
2,319,147 A * 5/1943 Mason ..... A47J 45/062 16/421
2,440,712 A * 5/1948 Bickell ..... B66C 1/127 294/77
2,789,742 A * 4/1957 De Salvo ..... A45F 5/021 224/271
2,991,539 A * 7/1961 Higgins ..... B66C 1/127 182/138
3,317,098 A * 5/1967 Auraen ..... B27B 17/0008 224/250
3,886,773 A * 6/1975 McGahee ..... A44B 15/00 224/255
3,908,875 A * 9/1975 Wilson ..... A45C 1/04 2/338
4,066,144 A * 1/1978 Valerio, Jr. ..... A62B 1/22 182/140
4,847,729 A * 7/1989 Hee ..... A61N 1/14 224/175
4,982,813 A * 1/1991 Starr ..... E04G 21/3261 182/138
5,082,156 A * 1/1992 Braun ..... A45F 5/00 224/220
5,167,299 A * 12/1992 Nusbaum ..... E04G 21/3261 182/138
5,274,885 A * 1/1994 Hellweg ..... A45F 5/02 224/272
5,385,282 A * 1/1995 Chen ..... A45F 5/02 224/269
5,540,367 A * 7/1996 Kauker ..... A45F 5/02 224/180
5,613,236 A * 3/1997 Tajima ..... A45F 5/02 224/269
5,664,712 A * 9/1997 Smrt ..... A45F 5/02 224/250
5,689,076 A * 11/1997 Usuda ..... G10D 13/00 224/197
5,785,221 A * 7/1998 Bishop ..... A45F 5/02 206/38
5,941,434 A * 8/1999 Green ..... A45F 5/02 224/195
5,979,019 A * 11/1999 Johnson ..... A44B 11/001 224/269
6,000,103 A * 12/1999 Paice ..... A45F 5/02 206/38
6,000,591 A * 12/1999 Alexander ..... A45F 3/14 211/113
6,026,662 A * 2/2000 Schlipper ..... A45C 3/001 70/14
6,131,780 A * 10/2000 Becker ..... A45F 3/04 224/148.6
6,244,081 B1 * 6/2001 Schlipper ..... A45C 13/002 70/14
6,318,610 B1 * 11/2001 Doherty ..... A45F 5/02 224/269
6,389,655 B2 * 5/2002 Libecco ..... B60P 7/0823 24/129 R
6,530,131 B1 * 3/2003 Hopkins ..... A45F 5/00 24/3.13
6,626,333 B2 * 9/2003 Levesque ..... A45F 3/04 215/399
6,669,064 B2 * 12/2003 Perricone ..... A61J 9/001 215/11.3
6,837,472 B1 * 1/2005 Beutz ..... A45F 3/16 224/148.4
6,871,767 B2 * 3/2005 Perlman ..... B43K 23/04 206/214
7,069,753 B2 * 7/2006 Schlipper ..... A45C 13/1046 70/14
7,228,601 B2 * 6/2007 Thompson ..... F16B 45/02 24/598.2
7,234,207 B2 * 6/2007 Goldberg ..... F16B 45/02 224/269
7,320,159 B2 * 1/2008 Petzl ..... F16B 45/02 24/599.5
7,594,354 B1 * 9/2009 Chadwick ..... A01K 97/10 224/258
7,828,180 B2 * 11/2010 Slesar ..... A45F 5/02 119/776
7,980,435 B2 * 7/2011 Tages ..... A45F 5/00 224/269
8,016,073 B2 * 9/2011 Petzl ..... F16B 45/02 182/3
8,060,994 B2 * 11/2011 Petzl ..... F16B 45/02 24/599.9
8,117,721 B2 * 2/2012 Yang ..... F16B 45/02 24/599.5
8,136,693 B2 * 3/2012 Thatcher ..... A45F 3/16 215/399
8,156,617 B2 * 4/2012 Schwappach ..... F16B 45/02 24/599.5
8,157,140 B2 * 4/2012 Jay ..... A45C 1/06 224/269
8,245,369 B2 * 8/2012 Hortnagl ..... F16B 45/02 24/599.5
8,267,290 B2 9/2012 Schlipper
8,292,137 B2 10/2012 Schlipper
8,322,586 B2 * 12/2012 Davis ..... A45F 5/02 224/197
8,333,310 B2 * 12/2012 Tages ..... A45F 5/02 224/197
8,365,365 B2 2/2013 Schlipper
8,387,218 B2 * 3/2013 Strasser ..... F16B 45/025 182/3
8,402,616 B2 * 3/2013 Petzl ..... F16B 45/02 24/599.6
8,474,112 B2 * 7/2013 Thompson ..... F16B 45/02 24/582.11
8,474,891 B2 * 7/2013 Shields ..... A45F 5/02 224/269
8,499,986 B2 * 8/2013 Knight ..... A45F 5/021 224/197
8,544,153 B2 * 10/2013 Mayberry ..... F16B 2/10 224/150
8,572,819 B2 * 11/2013 Yang ..... F16B 45/02 24/599.5
8,584,323 B2 * 11/2013 Pang ..... A61M 5/1418 24/132 R
8,621,728 B2 * 1/2014 Christianson ..... F16B 45/02 24/599.5
8,622,264 B2 * 1/2014 Messner ..... A45F 5/02 224/148.4
8,714,308 B2 5/2014 Schlipper
2003/0010801 A1 1/2003 Schlipper
2003/0102346 A1 * 6/2003 Chen ..... A45F 3/14 224/675
2003/0141160 A1 7/2003 Schlipper
2006/0188179 A1 8/2006 Schlipper
2011/0011677 A1 * 1/2011 Schlipper ..... E04G 21/3261 182/138
2013/0276941 A1 10/2013 Schlipper
2014/0069757 A1 3/2014 Schlipper
2014/0090942 A1 4/2014 Schlipper
2014/0105522 A1 * 4/2014 Schlipper ..... B65D 29/00 383/117

OTHER PUBLICATIONS

Dropsafe. "Dropsafe Mesh Pouch: Secure Your Two Way-Radios and Portable Gas Detectors with the New Dropsafe pouch," 2013.

* cited by examiner

SAFETY TETHER FOR A HAND-HELD ARTICLE

TECHNICAL FIELD

The present invention relates to a drop protection safety tether to attach a hand-held article to a user, particularly when working overhead.

BACKGROUND OF THE INVENTION

When working overhead, in order to protect anyone below, a safety apparatus such as a safety net may be suspended below the working area to arrest items that may fall. Overhead fittings can be safeguarded in a similar way by a fall arrest net, as described in US20140105522A1.

Another approach, particularly for securing hand-held items that might be dropped, such as hand tools, portable communication devices, aerosol cans, and the like, is to provide a tether line fixed at one end directly to the tool and at the other end to a special-purpose tool belt, such as a builder's apron. The drawbacks with this approach includes the difficulty of connecting the tether line to the article in a way that is sufficiently secure and does not unduly restrict proper use of the article. The tether lines themselves are a nuisance to the user as, due to their lengths, they tend to get caught up on different objects. Furthermore, while a tool belt has pockets for holding hand-held articles when not in use, it is a large item to wear if only a single hand-held article is used. It is an objective of the present invention to overcome or substantially ameliorate the above disadvantages or, more generally, to provide an improved safety tether for providing drop protection for hand-held articles.

DISCLOSURE OF THE INVENTION

According to one aspect of the present invention there is provided a safety tether for a hand-held article, comprising:

- a resilient bag for receiving the article, the bag being constructed of wire mesh, the wire mesh being formed by joining portions of a wire at nodes such that the bag is biased to a collapsed state, the bag having a mouth;
- a plurality of mouth loops of the mesh being circumferentially spaced around the mouth,
- a retractable leash for attaching the bag to a user, the leash having opposing first and second ends, the first end being configured for attachment to the user, as to a belt, or clothing item worn by the user;
- a hook fastener including a hook configured for passing through the mouth loops to draw the mouth of the bag closed and a gate for closing the hook to retain the mouth loops, the hook fastener being connected to the second end of the retractable leash, and
- a clip fixed to the bag by which the bag may be hung, the clip having a recess for receiving the belt, or clothing item.

Preferably the bag that is generally symmetrical about a longitudinal axis and includes a bottom end opposite the mouth, the bottom end including circumferentially spaced bottom loops of the mesh defining an end opening generally concentric with the longitudinal axis.

Preferably the end opening being approximately sized to receive the nozzle of an aerosol spray can.

Preferably the retractable leash comprises a resilient helical or spiral coil, wherein the first end comprises a first loop for coupling to the belt; the second end has a second loop by which the hook fastener is fixed.

Preferably the belt clip is fixed to the bag by fasteners that secure a block to the clip such that at least one of the nodes is captured between the clip and block.

Preferably the belt-receiving recess faces substantially toward the mouth of the bag, the clip and the block have respective abutment faces, at least one of the abutment faces including channels for receiving the node and the wire, wherein the fasteners clamp the abutment faces together, and a plurality of projections on the abutment face of the clip partially covers a length of the channels on the abutment face of the block.

Preferably the abutment faces are elongate, the channels include a generally centrally positioned node-receiving cavity, the channels radiate outward from the node-receiving cavity in an X-shaped form, such that ends of first and second pairs of channels are disposed near longitudinally opposing ends of the abutment faces, and wherein a concavity in the clip receives the block.

Preferably the hook has a generally C-shaped body having a first end region, a second end region, and an elongated section therebetween; the gate is mounted at the second end region and is pivotable between a closed position and an open position;

a sleeve is screw-threaded for movement axially between first and second positions in which the first end region is spaced from and received in the sleeve respectively, and a resilient biasing means urges the sleeve toward its second position.

Preferably each node comprises a crimped fastening enclosed by a two-piece cover in which the two pieces are connected by integral fastening means.

Preferably each of the pieces is moulded from a resilient polymeric material and includes a body portion, the body portions covering opposite sides of the crimped fastening, and wherein the integral fastening means extend along opposite edges of the body portions and comprise, on one of the pieces, a rib defining an elongate notch and, on the other of the pieces, a tongue received in the notch.

Preferably the ribs are substantially parallel to a cover axis, a respective cavity in each of the pieces has a form complementary to the crimped fastening, a pair of grooves at axially opposite ends of each of the pieces receive the wire, the grooves diverging as they extend outwardly from the cavities.

Preferably the bag further comprises a reinforcement formed in at least one of the mouth loops, wherein in use the hook is passed through an eye of the reinforcement.

Preferably the reinforcement is a one-piece member in which a length of the mouth loop extends circumferentially about the eye, and the wire passes through integral retaining parts circumferentially spaced around the eye to connect the loop to the reinforcement.

This invention provides a safety tether which is effective and efficient in reducing potential drop hazards. The device may be economically constructed and has an overall simple design which minimizes manufacturing costs. Further aspects will become apparent to the person skilled in the art from the description and appended claims which are given by way of example only to illustrate one or more embodiments of the invention.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
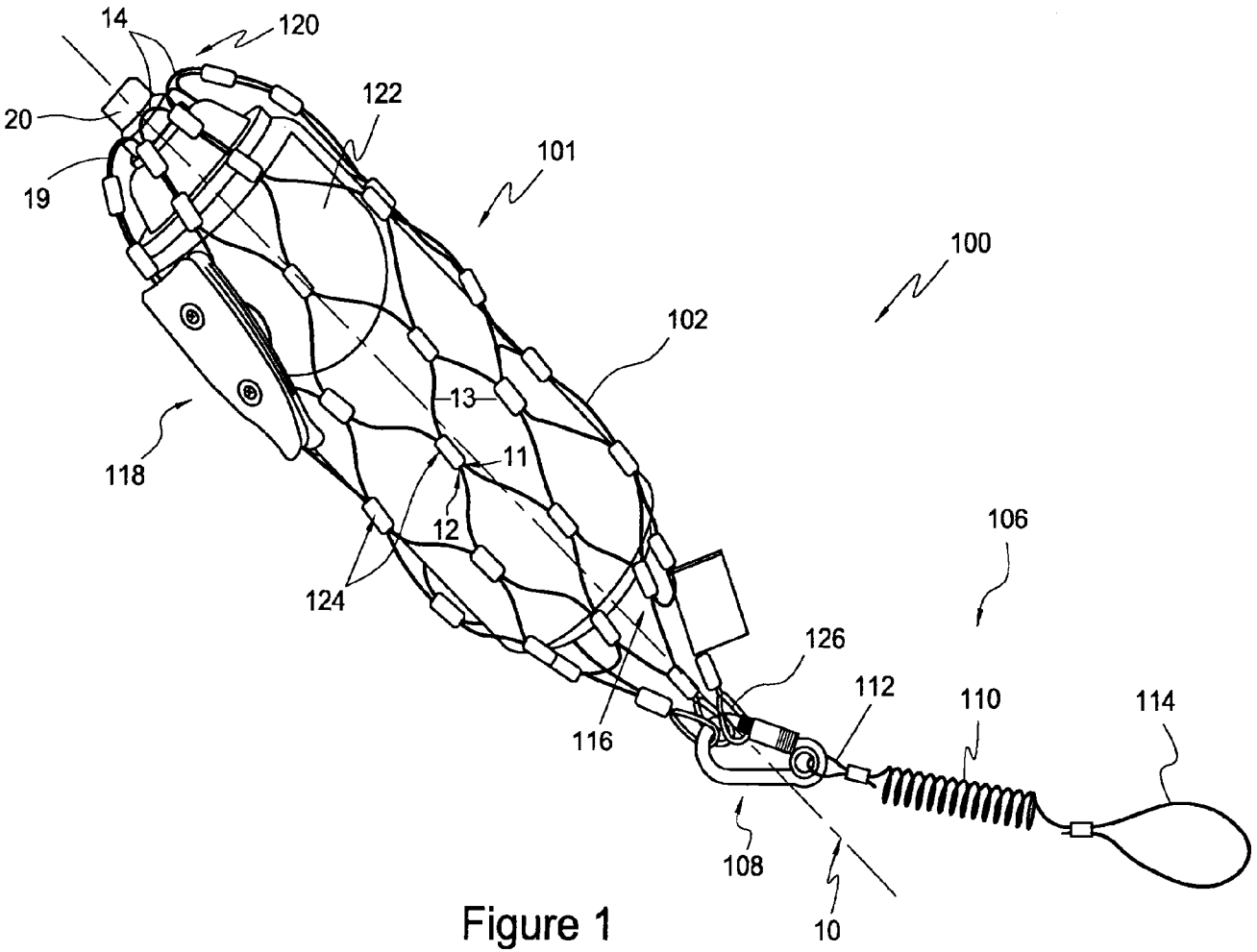
FIG. 1 is a pictorial view of the safety tether in accordance with a first embodiment of the invention.
Figure 2:
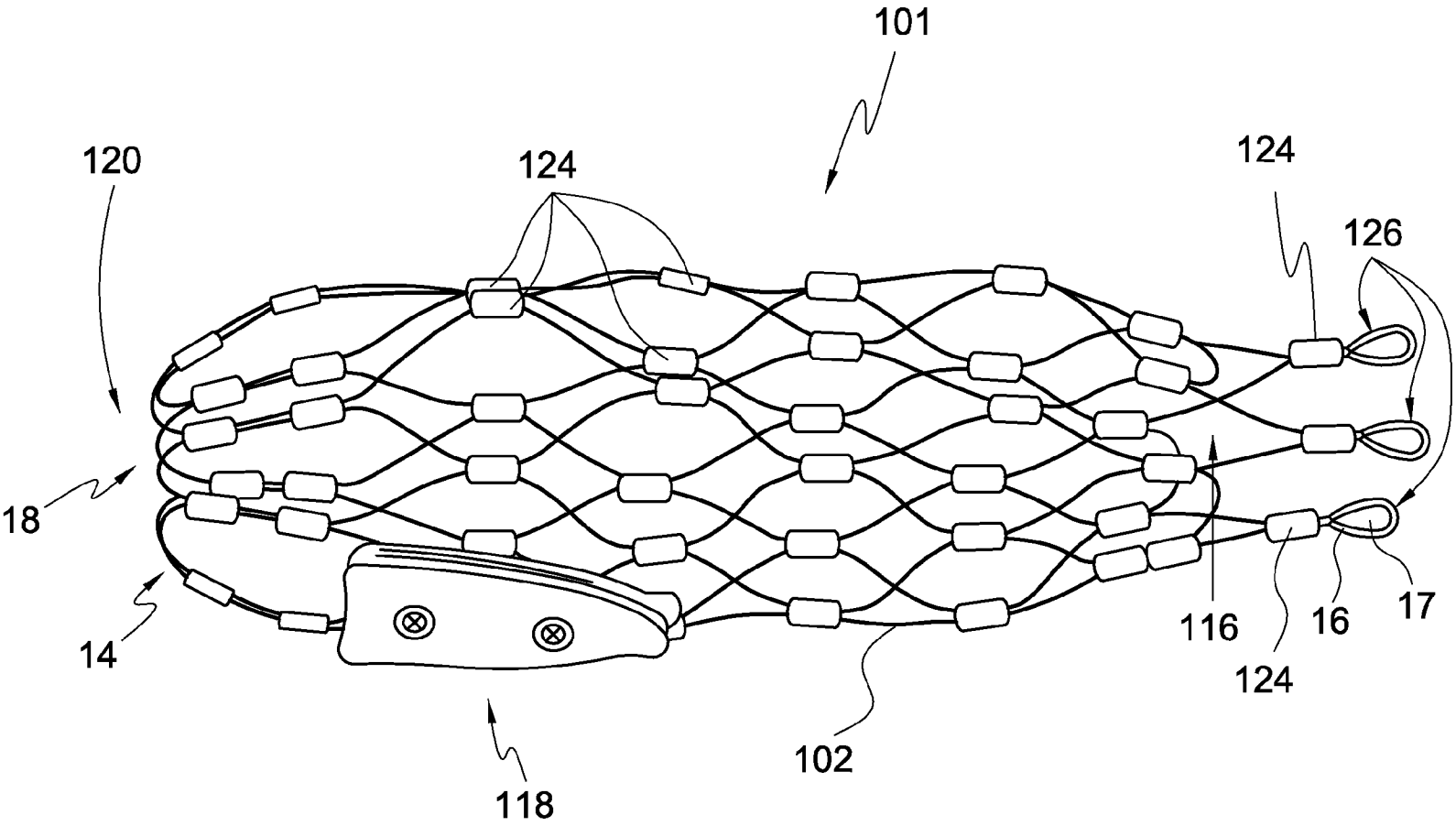
FIG. 2 is a side view of the bag of the safety tether of FIG. 1.

With reference to FIGS. 1 and 2, there is illustrated an embodiment of a safety tether 100 comprising a resilient bag 101 for receiving and retaining a hand-held article, such as an aerosol can 122. The bag 101 is constructed of wire mesh formed by joining at nodes 124 portions of a wire 102, such as portions of a single length of twisted or woven multi-stranded steel wire. The bag 101 has a mouth 116 and closed end 120 generally concentric with a longitudinal axis 10 and disposed at longitudinally opposing ends. The wire 102 comprises a plurality of wave-shape lengths that each extend generally longitudinally, alternating lengths running in opposite directions with the wire turning back upon itself at loops 126, 14 that extend between the lengths at the mouth 116 and closed end 120 respectively. Crests 11 and troughs 12 of adjacent lengths are joined at the nodes 124 and the lengths combine to encircle the axis 10, producing a bag 101 with rotational symmetry about the axis 10. Except for the loops 126, each opening 13 in the mesh may thus extend between adjacent lengths that run in opposite directions and which are defined by at least four nodes 124. The flexibility and resilience of the wire 102 mean that the bag is biased to a collapsed state or small diameter for holding small items and it collapses for storage when not in use, but it can be readily expanded to a substantial extent in the radial direction to hold items with a larger transverse dimension. This flexibility combined with the openings 13 in the mesh provide a means of retaining items of a multitude of different shapes, especially items with protruding parts such as spray nozzles and antennae.

The mouth loops 126 of the mesh are circumferentially spaced around the mouth 116 and each may be defined by a single node 124. The mouth loops 126 may each include a reinforcement 16 defining an eye 17 formed as by coating the wire of the mouth loops 126 with a plastic reinforcing material. The end loops 14 of the mesh are circumferentially spaced around the closed end 120 and each may be defined by five nodes 124 providing greater stiffness to the closed end 120 and providing less variability in the dimension of an end opening 18 defined between the endmost parts of the end loops 14. The end opening 18 in this way is adapted to engage an annular flange 19 next to the spray nozzle 20 of the aerosol can 122 such that the nozzle 20 projects from the closed end 120 allowing it to be used normally while it remains held in the bag 101.

Figure 3:
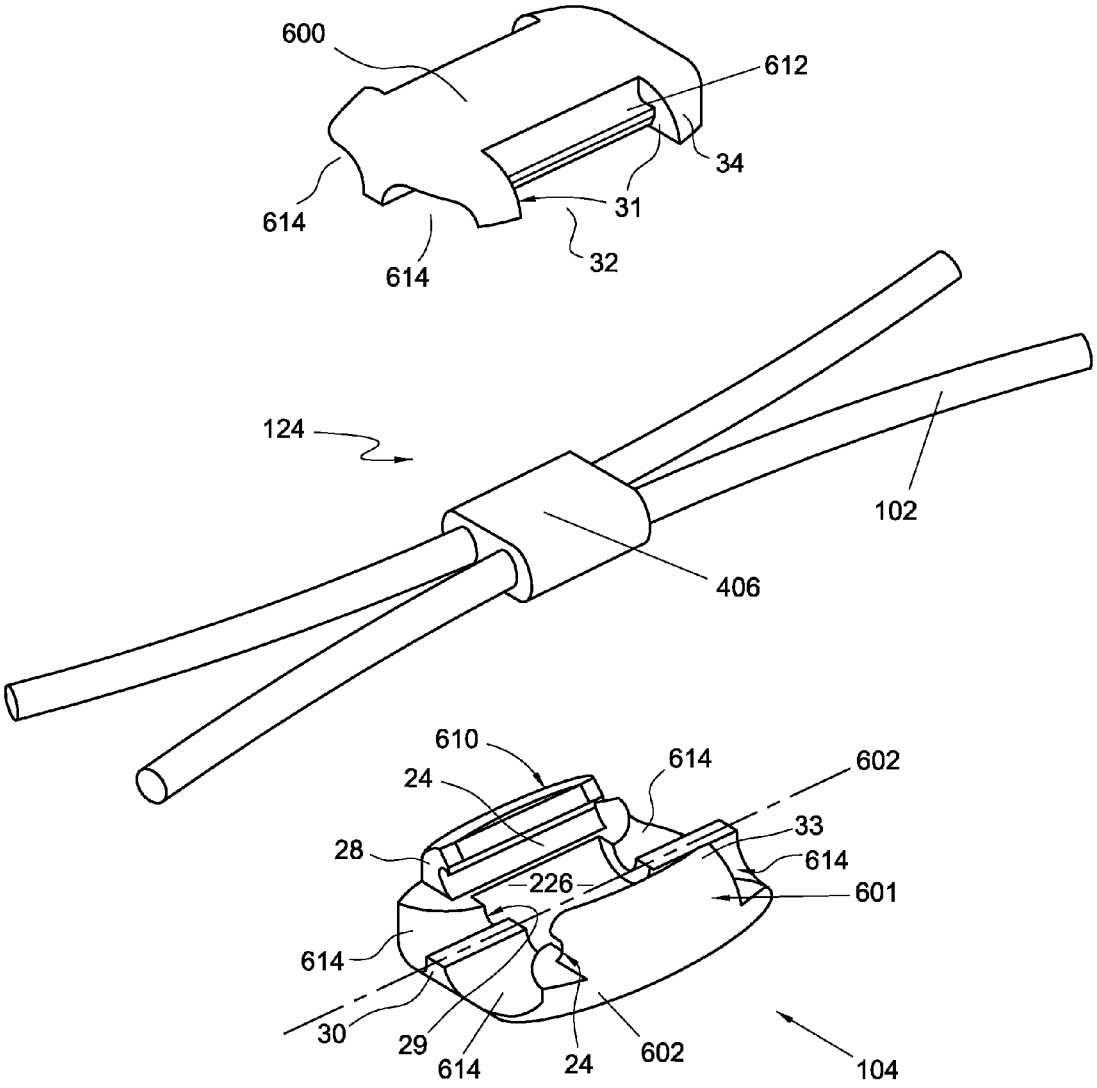
FIG. 3 is an exploded view of a node of the mesh bag of FIG. 1.
Figure 4:
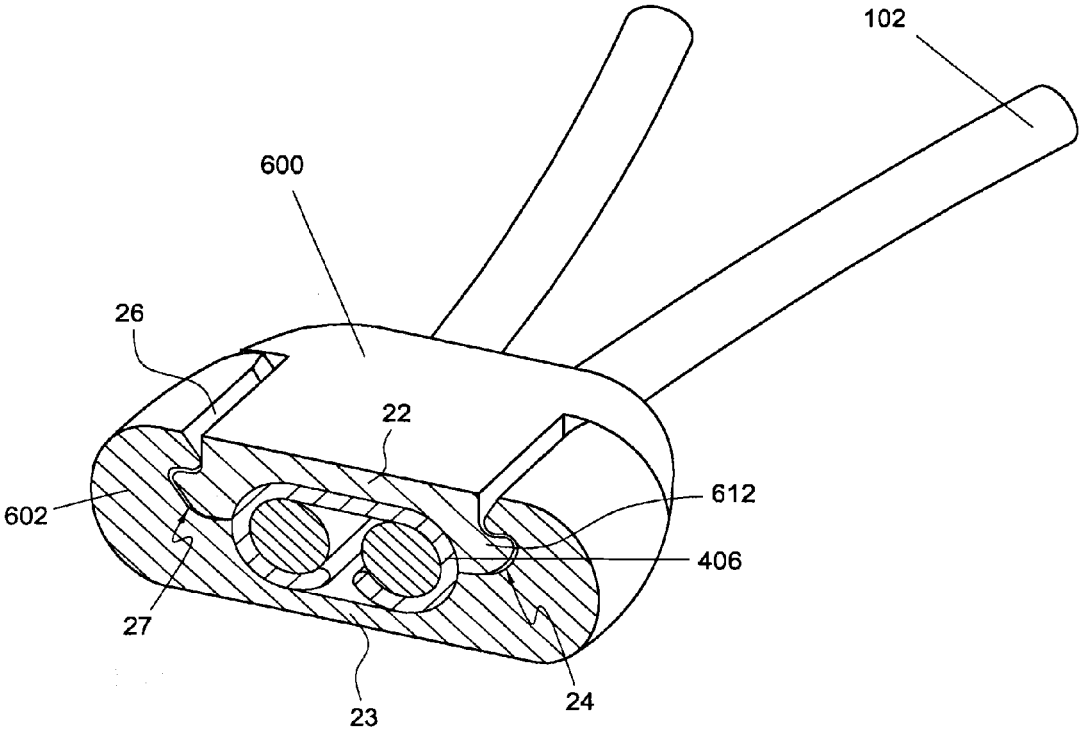
FIG. 4 is a part sectional view of the node of FIG. 3.

As shown in FIGS. 3 and 4, at the nodes 124 portions of the wire 102 may be connected by a crimped fastening 406 that is further enclosed by a two-piece cover 600, 602 to protect contents of the bag 101 from contacting the crimped fastenings 406. The two-piece cover may comprise a first piece 600 and a second piece 602 which are of different construction. Both pieces 600, 602 may be moulded from a resilient polymeric material and have a respective body portion 22, 23 for covering opposite sides of the crimped fastening 406. Along the longitudinal sides of the first piece 600 are integral fastening means in the form of ribs 610 each defining an elongated notch 24 that may be substantially parallel to a cover axis 620. On the opposing longitudinal sides of the second piece 600 are tongues 612 that are of complementary shape to the notches 24. A cavity 226 in each of the pieces 600, 602 has a form complementary to the crimped fastening 406 received therein. A pair of grooves 614 extends from axially opposite ends of each of the pieces into the cavities 226 to provide a passage for the wire 102. The grooves 614 of each pair diverge from one another, and each groove 614 has a divergent shape, increasing in width as it extends outwardly from the cavity 26. This divergent shape accommodates the movement of the wire required during radial expansion and contraction of the bag 101. Longitudinally opposite ends of the ribs 610 may terminate in generally coplanar transverse faces 28 offset longitudinally inwardly of end faces 30 of the piece 602. In turn, the end faces 29 of the cavities 26 may be offset longitudinally inwardly of the transverse faces 28. When assembled, the transverse faces 28 of the piece 602 are disposed adjacent transverse faces 31 of edge recesses 32 provided in the piece 600 and the outermost surfaces 33 and 34 of the respective pieces 602, 600 are convex or flat and blend smoothly with one another to present a smooth profile to the contents of the bag. Mating faces 26, 27 on the pieces abut during assembly and are inclined so that the rib 610 and tongue 612 are elastically deformed when the two pieces are pressed together, before the tongue 612 moves into the notch 24 to fix the pieces 602, 600 together by a snap fit.

Figure 5:
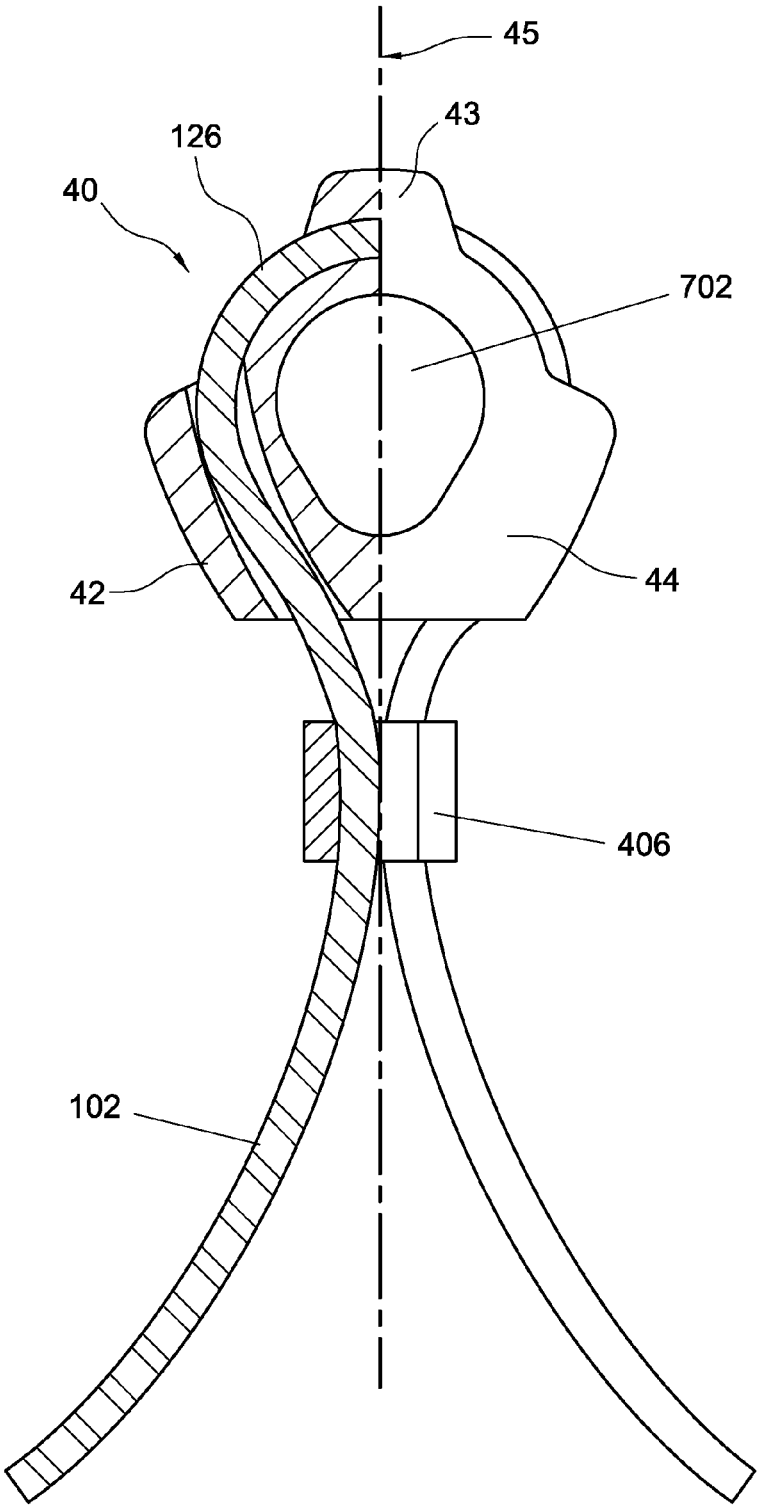
FIG. 5 is a half-sectional side view of a mouth loop reinforcement of a second embodiment of the invention.

FIG. 5 illustrates an alternative to the over moulded reinforcement 16 in the form of a reinforcement 40 that is adapted to have the wire 102 threaded through it during manufacture. Without reinforcement, the hook fastener 108 can wear and damage the mouth loops 126 over time. The reinforcement 40 is a one-piece member in which a length of a mouth loop 126 extends circumferentially about an ovate eye 702 formed in the centrally in the reinforcement 40. The wire 102 passes through wire-enclosing openings in integral retaining parts 42-44 circumferentially spaced around the eye 702, the retaining parts 42-44 connecting the loop 126 to the reinforcement 40. The wire-enclosing openings through the retaining parts 42-44 have a relatively short circumferential dimension and correspondingly a small curvature, allowing an end of the wire 102 to be readily pushed through them sequentially.

Figure 6:
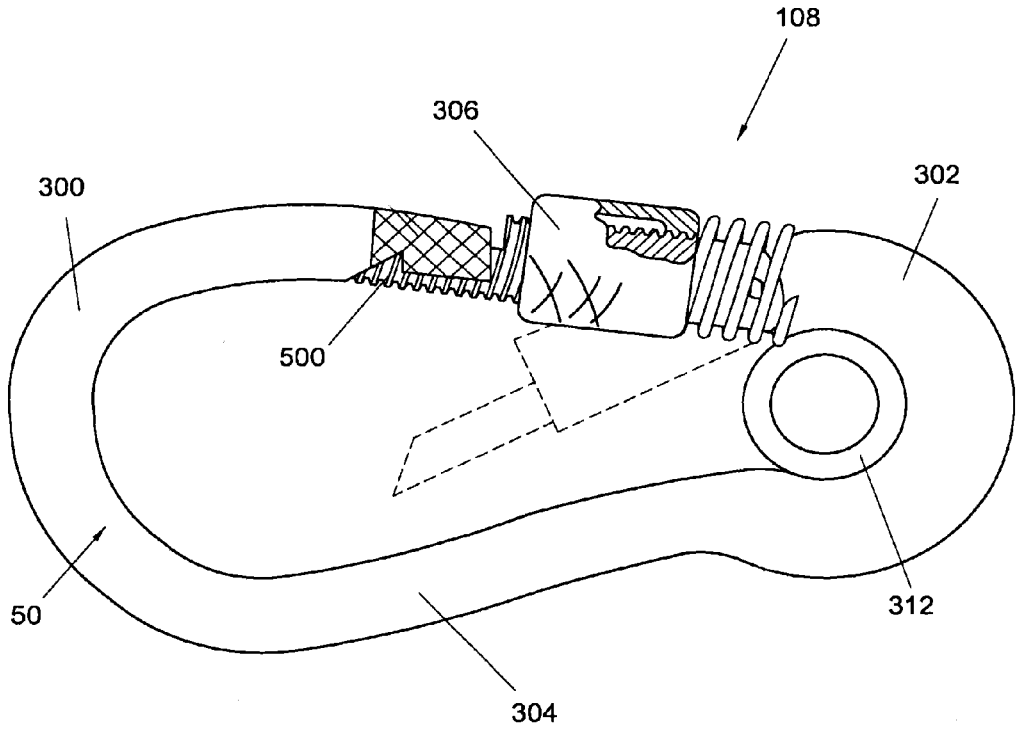
FIG. 6 is a side view of a hook fastener of the safety tether of FIG. 1.

Referring to FIGS. 1 and 6, a leash assembly includes a retractable leash 106 for attaching the bag 101 to a user and a hook fastener 108. The retractable leash 106 may comprise a resilient helical wire coil 110 with a first loop 114 at one end for coupling to the belt (not shown) of a user and a second loop 112 at the opposite end by which a hook fastener 108 is fixed. The loops 112, 114 may be formed by ferrules crimped to the wire of the leash 106. The first loop 114 may be sized to receive a belt worn by a user, or else sized to allow the hook fastener 108 to pass through the loop 114, so that the leash 106 can be fixed to the belt without the user needing to remove the belt. The leash 106 may be plastic coated for protection.

The hook fastener 108 includes a hook 50 configured for passing through the mouth loops 126 to draw the mouth 116 of the bag 101 closed and a gate 500 for closing the hook 50 to retain the loops 126. The hook 50 may be a generally C-shaped body having end regions 300, 302 with large and small radii of curvature respectively which are connected by an elongated section 304 in between. The smaller end region 302 retains an annular insert 312 by virtue of defining a neck smaller than the diameter of the annular insert 312. The loop 112 passes through the annular insert 312 to fix the hook fastener 108 to the retractable leash 106. A gate 500 may be pivotably mounted at the smaller end region 302 near the annular insert 312 and may be pivotable between the closed position shown and an open position indicated in dashed outline. The gate 500 may be biased to the closed position by a torsion spring (not shown) for preventing unwanted opening. A threaded sleeve 306 is engaged with a threaded end of the gate 500 for locking the gate 500 closed.

Figure 7:
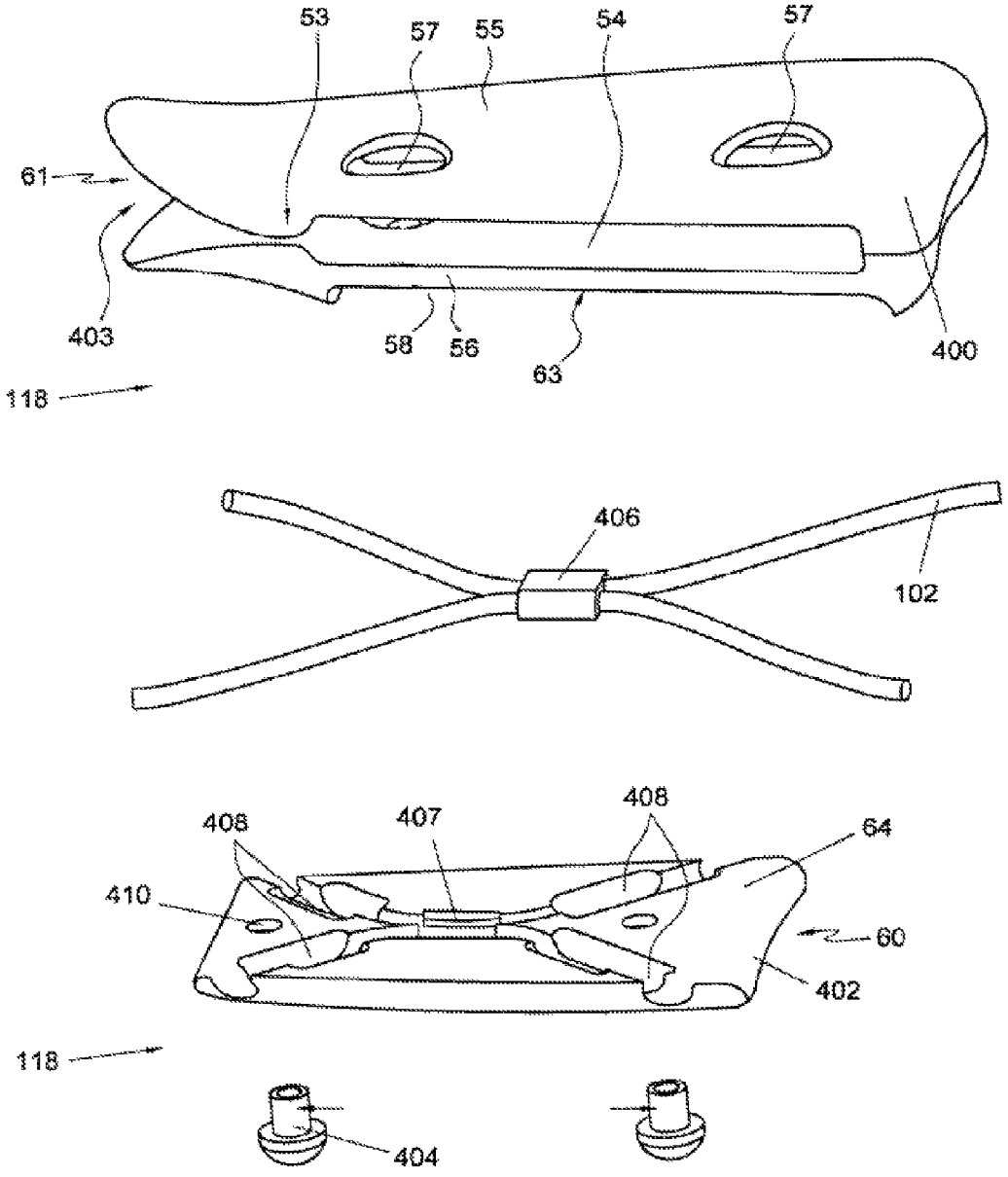
FIG. 7 is an exploded view of the belt clip of FIG. 1.

The clip 118 is shown fixed to a node of the bag 101 in FIG. 1 and separated from the bag FIG. 7, and it has a recess 403 for receiving a belt, or a like item such as part of a pocket, thus allowing the bag 101 and any contents to be hung from the user's apparel when not in use. The clip 118 is made of resilient material and comprises generally planar outer and inner sections 55, 56 between which the recess 403 is defined, and which are integrally joined to form a generally C-shaped part. Starting from its longitudinal open end, the recess 403 tapers inwardly in the longitudinal direction until a neck 53 is reached, after which it diverges to a belt-receiving portion 54 of substantially constant cross-section throughout its length. The clip 118 is fixed to the bag 101 proximate the closed end 120. The clip 118 is elongated generally in the longitudinal direction of the bag 101 with longitudinal open end 61 nearest the mouth 116 of the bag 101 such that the belt-receiving recess faces substantially toward the mouth 116.

Figure 8:
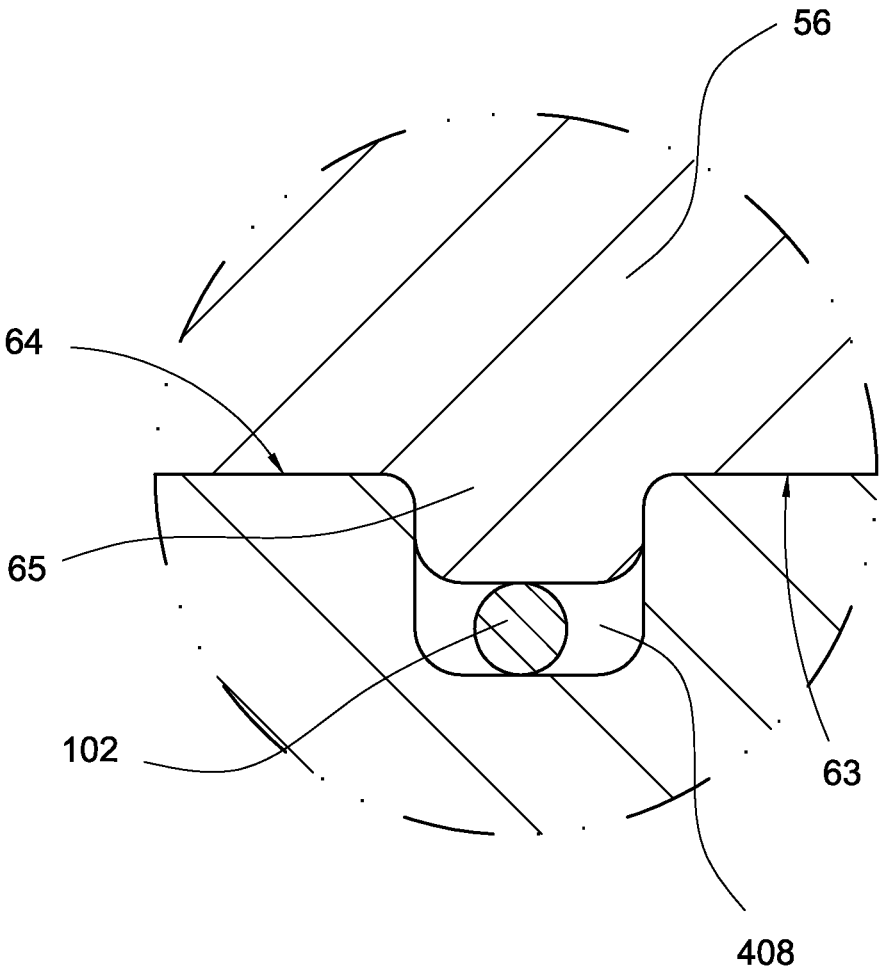
FIG. 8 is a fragmentary cross section through a wire-receiving channel on the clip of FIG. 7.

Two rivet-receiving apertures 58 may be provided in the inner section 56 in registration with larger tool-receiving apertures 57 in the outer section. An oblong recess 59 may be provided in an inner face of the inner section 56 for receiving a complementary oblong block 60 in which openings 410 are provided in alignment with the rivet-receiving apertures 58. The clip 403 and the block 60 have respective abutment faces 63, 64 which may be approximately planar. The abutment face 64 includes channels 408 for receiving the wire that diverge from a central node-receiving cavity 407 for receiving a crimped fastener 406 that defines a node of the mesh. The channels 408 radiate outward from the node-receiving cavity 407 in an X-shaped form, such that ends of first and second pairs of channels 408 are disposed near longitudinally opposing ends of the abutment face 64. As shown in FIG. 8, projections 65 from the abutment face 63 of the clip 118 extend into each of the channels 408 and partially cover a length of the channels 408 in the block. The clip 118 is thus fixed to the bag 101 by rivets 404 that secure the block 60 thereto such that the node is captured between the clip 118 and block 60, with the abutment faces 63, 64 clamped to one another.

In use, the leash assembly may be disconnected from the bag 101 and the loop 114 passed around the user's belt, without the user needing to remove the belt. Then the hook fastener 108 passes through the loop 114, securing the leash 106 to the belt. The mouth 116 may be opened wide enough for a user to insert an article into the bag 101 and arrange it in a suitable manner such that the closed end 120 is generally uppermost when the article is used, and thus allowing the leash 106 to be relatively short. Advantageously in the case of the aerosol can 122 shown, the nozzle 20 projects through the end opening 18. The natural tendency of the bag 101 is to compress into a compact form around the item, reducing opportunities for it to become caught by other objects in the working environment. The mouth 116 of the bag 101 can then be closed to retain the aerosol can 122. The hook fastener 108 is used to collect the mouth loops 126 before it is secured by turning the sleeve 306. The device thus allows the user to use the aerosol can 122 normally, even maintaining contact directly with its surface, all while the article is safely held within the bag 101. When working overhead the device thus provides a high degree of safety. When temporarily unneeded the aerosol can 122 and bag 101 can be hung from the user's belt by the clip 118.

Aspects of the present invention have been described by way of example only and it should be appreciated that modifications and additions may be made thereto without departing from the scope thereof.

The invention claimed is:

1. A safety tether bag for a hand-held article, comprising:
- a resilient bag for receiving the article, the bag being constructed of wire mesh, the wire mesh being formed by joining portions of a wire at nodes such that the bag is biased to a collapsed state, the bag being generally symmetrical about a longitudinal axis and including:
  - a mouth; and
  - an end opening at a bottom end opposite the mouth, the end opening generally concentric with the longitudinal axis;
- a plurality of mouth loops of the mesh being circumferentially spaced around the mouth;
- a plurality of bottom loops of the mesh being circumferentially spaced around the end opening;
- a hook fastener including:
  - a hook configured for passing through the mouth loops to draw the mouth of the bag closed; and
  - a gate for closing the hook to retain the mouth loops;
- a retractable leash for attaching the bag to a user, the leash having opposing first and second ends, the first end being configured for attachment to the user; and the second end connected to the hook fastener; and
- a clip fixed to the bag by which the bag may be hung, the clip having a recess for receiving a clothing item worn by the user, wherein the clip is fixed to the bag by fasteners that secure a block to the clip such that at least one of the nodes is captured between the clip and block, wherein the recess faces substantially toward the mouth of the bag, the clip and the block have respective abutment faces, at least one of the abutment faces including channels for receiving the node and the wire, wherein the fasteners clamp the abutment faces together, and a plurality of projections on the abutment face of the clip partially covers a length of the channels on the abutment face of the block.

2. The safety tether bag of claim 1 wherein the end opening is approximately sized to receive a nozzle of an aerosol spray can.

3. The safety tether bag of claim 1 wherein the abutment faces are elongate, the channels include a generally centrally positioned node-receiving cavity, the channels radiate outward from the node-receiving cavity in an X-shaped form, such that ends of first and second pairs of channels are disposed near longitudinally opposing ends of the abutment faces, and wherein a concavity in the clip receives the block.

4. The safety tether bag of claim 1 wherein the hook a generally C-shaped body having a first end region, a second end region, and an elongated section therebetween; wherein the gate is mounted at the second end region and is pivotable between a closed position and an open position; and the hook fastener further includes:
- a sleeve is screw-threaded for movement axially between first and second positions in which the first end region is spaced from and received in the sleeve respectively; and
- a resilient biasing means urges the sleeve toward its second position.

5. The safety tether bag of claim 1 wherein each node comprises a crimped fastening enclosed by a cover, the cover including two pieces connected together by integral fastening means.

6. The safety tether bag of claim 5 wherein each of the two pieces is molded from a resilient polymeric material and includes a body portion, the body portions covering opposite sides of the crimped fastening, and wherein the integral fastening means extend along opposite edges of the body portions and comprise, on one of the two pieces, a plurality of ribs defining a plurality of elongate notches and, on the other of the two pieces, a plurality of tongues corresponding to the ribs, each of the tongues received in a corresponding one of the notches.

7. The safety tether bag of claim 6 wherein the ribs are substantially parallel to a cover axis, a respective cavity in each of the two pieces has a form complementary to the crimped fastening, a pair of grooves at axially opposite ends of each of the pieces receiving the wire, the grooves diverging as they extend outwardly from the cavities.

8. The safety tether bag of claim 1 further comprising a reinforcement formed in at least one of the mouth loops, wherein in use the hook is passed through an eye of the reinforcement.

9. The safety tether bag of claim 8 wherein the reinforcement is a one-piece member in which a length of the mouth loop extends circumferentially about the eye, and the wire passes through integral retaining parts circumferentially spaced around the eye to connect the loop to the reinforcement.

10. A safety tether bag for a hand-held article, comprising:

a resilient bag for receiving the article, the bag being constructed of wire mesh, the wire mesh being formed by joining portions of a wire at nodes such that the bag is biased to a collapsed state, the bag being generally symmetrical about a longitudinal axis and including:

a mouth; and an end opening at a bottom end opposite the mouth, the end opening generally concentric with the longitudinal axis;

a plurality of mouth loops of the mesh being circumferentially spaced around the mouth;

a plurality of bottom loops of the mesh being circumferentially spaced around the end opening;

a hook fastener including:

a hook configured for passing through the mouth loops to draw the mouth of the bag closed; and a gate for closing the hook to retain the mouth loops; and a reinforcement formed in at least one of the mouth loops, wherein in use the hook is passed through an eye of the reinforcement, wherein the reinforcement is a one-piece member in which a length of the mouth loop extends circumferentially about the eye, and the wire passes through integral retaining parts circumferentially spaced around the eye to connect the loop to the reinforcement.

* * * * *